US007360290B2

(12) United States Patent
Nozaki et al.

(10) Patent No.: US 7,360,290 B2
(45) Date of Patent: Apr. 22, 2008

(54) METHOD OF MANUFACTURING ROCKER ARM

(75) Inventors: Eiichi Nozaki, Nishio (JP); Kenkichi Kuwahara, Nishio (JP); Satoshi Suzuki, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 92 days.

(21) Appl. No.: 11/474,455

(22) Filed: Jun. 26, 2006

(65) Prior Publication Data

US 2007/0000297 A1 Jan. 4, 2007

(30) Foreign Application Priority Data

Jul. 4, 2005 (JP) ..... 2005-195202

(51) Int. Cl.
*B23K 3/00* (2006.01)
*B21D 53/84* (2006.01)

(52) U.S. Cl. ..... 29/34 R; 29/888.2; 123/90.39; 74/559; 72/356

(58) Field of Classification Search ..... 29/34 R, 29/888.2, 888.1, 557, 558; 123/90.39, 90.41, 123/90.42, 90.43, 90.44, 90.45; 74/559, 74/569; 72/379.2, 356
See application file for complete search history.

(56) References Cited

U.S. PATENT DOCUMENTS 5,048,475 A * 9/1991 Mills ..... 123/90.39
5,720,245 A * 2/1998 Calka ..... 123/90.41
5,819,694 A * 10/1998 Trutescu et al. ..... 123/90.43
6,151,948 A 11/2000 Ashworth et al.
6,199,527 B1 * 3/2001 Okubo et al. ..... 29/888.2
6,334,416 B2 * 1/2002 Okubo et al. ..... 123/90.42
6,425,361 B1 * 7/2002 Motohashi ..... 29/888.2
6,508,215 B2 * 1/2003 Okubo et al. ..... 123/90.39
6,588,101 B2 * 7/2003 Okubo et al. ..... 29/888.2
6,601,555 B2 * 8/2003 Okubo et al. ..... 29/888.2
6,615,635 B2 * 9/2003 Ammon ..... 29/888.2
6,672,266 B2 * 1/2004 Okubo et al. ..... 123/90.39

(Continued)

FOREIGN PATENT DOCUMENTS

EP 1 450 007 A1 8/2004

(Continued)

*Primary Examiner*—Dana Ross
(74) *Attorney, Agent, or Firm*—McGinn IP Law Group, PLLC

(57) ABSTRACT

The present invention provides a method of manufacturing a rocker arm, having a process of rough processing, in which a metallic stock is subjected to compression-forming by cold forging to form a connecting portion, side wall lower portions of two side wall portions, and two projecting portions projecting beyond a rocker arm width outwardly from the side wall lower portions, and to form, at tip ends of the side wall lower portions, two stem guides projecting downwardly lower than a pat surface level of the connecting portion, a process of formation of a side wall, in which at least a part of the two projecting portions is subjected to ironing processing to form side wall upper portions of the two side wall portions, thereby forming the two side wall portions accommodated in a rocker arm width, and a process of working of a stem guide, in which the two side wall portions are subjected to ironing processing from outer surface sides, thereby increasing a projection height from which the stem guides project downwardly.

11 Claims, 17 Drawing Sheets

U.S. PATENT DOCUMENTS 6,959,676 B2 * 11/2005 Okubo et al. ..... 123/90.39
7,062,852 B2 * 6/2006 Shimizuya ..... 29/888.2

FOREIGN PATENT DOCUMENTS

JP 6-159018 6/1994
JP 07-269311 10/1995
JP 10-328778 12/1998
JP 2004-358530 12/2004
JP 2004-358538 12/2004

* cited by examiner

METHOD OF MANUFACTURING ROCKER ARM

TECHNICAL FIELD

The present invention relates to a method of manufacturing a rocker arm for valve gears of internal combustion engines from a metallic stock.

BACKGROUND OF THE INVENTION

In many rocker arms (in particular, rocker arms with a roller), a pat which pushes a valve stem, and a pivot bearing which bears a pivot, make a connecting portion, and there are provided two side wall portions upright from both ends of the connecting portion. The applicant of the present application has previously disclosed in Japanese Laid-open Patent Publication Number hei 06-159018 (No. JP-A-6-159018) a method of manufacturing a rocker arm, in which a stock is changed in thickness to be subjected to forge processing to make a pat, a pivot bearing, and a pair of sides in a predetermined shape of development, peripheral edges of the sides are subjected to stamping to have a predetermined shape, and thereafter, the sides are subjected to bending to be made upright to form side wall portions. A roller is mounted rotatably on the both side wall portions.

Also, Japanese Laid-open Patent Publication Number hei 10-328778 (No. JP-A-10-328778) discloses a method of manufacturing a rocker arm having a flat, relatively long and narrow shape, in which a multi-stage horizontal, cold forging machine is used to subject a metallic wire rod having a rectangular-shaped section to compression-forming in a diametrical direction by cold forging to form a connecting portion and a side wall portion, which are a little low in dimensional accuracy, and thereafter a connecting portion and a side wall portion, which are high in dimensional accuracy, are formed.

Also, Japanese Laid-open Patent Publication Number 2004-358530 (No. JP-A-2004-358530) discloses a method of manufacturing a rocker arm, in which a multi-stage horizontal, cold forging machine is used to shape a metallic wire rod, having a circular-shaped section, into a drum form, the rod is subjected to compression-forming from both sides in a diametrical direction by cold forging to form a connecting portion and a side wall portion, which are rough in shape and dimension, and thereafter a connecting portion and a side wall portion, which are further close to a finished product in terms of shape and dimension.

SUMMARY OF THE INVENTION

In the manufacturing method of JP-A-6-159018, since the side wall portion is formed by bending the side so as to make the same upright, it is easy to form even a high side wall portion, but there is caused a problem that a base end side connecting portion of the side portion, which defines a center of bending, is susceptible to crack. Also, there is caused a problem that a circular or elliptic stock of steel sheet illustrated as a metallic stock in the embodiment is expensive as compared with a metallic wire rod.

In the manufacturing methods of JP-A-10-328778 and JP-A-2004-358530, since a metallic wire rod is subjected to compression-forming in a diametrical direction by cold forging to directly form a vertically upright side wall portion, flow of metal is large and turns steeply, so that only a low side wall portion can be formed. In trying to form a high side wall portion, there is a fear that a stock is split or a metal mold is broken by a large heading and forging force. Also, horizontal, cold forging machines used for working are not large in size, and there is a limit to the number of stages of heading and forging stations, so that the number of processes is insufficient to perform fine processings through multi-stage processes.

Also, while two stem guides projecting downwardly lower than a pat level are formed on both sides of the pat, the manufacturing methods of JP-A-6-159018, JP-A-10-328778, and JP-A-2004-358530 involve a problem that since the stem guides are formed only by forging, a projection height from which the stem guides project downwardly is small and accuracy is insufficient.

Therefore, a first object of the invention is to form side wall portions without generation of defects such as crack, breakage, etc. on a metallic stock and a second object of the invention is to form stem guides which project a large height downwardly and have a high accuracy. In order to attain the first object, the invention adopts the following measures [1], [3] and in order to attain the second object, the invention adopts the following measures [2], [3].

[1] A method of manufacturing a rocker arm including two upright side wall portions and a connecting portion connecting between the side wall portions, the method comprising:

a process of rough processing, in which a metallic stock is subjected to compression-forming by cold forging to form a connecting portion, side wall lower portions of two side wall portions, and two projecting portions projecting beyond a rocker arm width outwardly from the side wall lower portions; and a process of formation of a side wall, in which at least a part of the two projecting portions is subjected to ironing processing to form side wall upper portions of the two side wall portions, thereby forming the two side wall portions accommodated in the rocker arm width.

[2] A method of manufacturing a rocker arm including two upright side wall portions and a connecting portion connecting between the side wall portions, the method comprising:

a process of rough processing, in which a metallic stock is subjected to compression-forming by cold forging to form a connecting portion, and side wall lower portions of two side wall portions, and to form, at tip ends of the side wall lower portions, two stem guides projecting downwardly lower than a level of a pat surface of the connecting portion; and a process of working of a stem guide, in which the two side wall portions are subjected to ironing processing from outer surface sides, thereby increasing a projection height from which the stem guide projects downwardly.

[3] A method of manufacturing a rocker arm including two upright side wall portions and a connecting portion connecting between the side wall portions, the method comprising:

a process of rough processing, in which a metallic stock is subjected to compression-forming by cold forging to form a connecting portion, side wall lower portions of two side wall portions, and two projecting portions projecting beyond a rocker arm width outwardly from the side wall lower portions and to form, at tip ends of the side wall lower portions, two stem guides projecting downwardly lower than a level of a pat surface of the connecting portion;

a process of formation of a side wall, in which at least a part of the two projecting portions is subjected to ironing processing to form side wall upper portions of the two side wall portions, thereby forming the two side wall portions accommodated in the rocker arm width; and a process of working of a stem guide, in which the two side wall portions are subjected to ironing processing from outer surface sides, thereby increasing a projection height from which the stem guide projects downwardly.

Here, the metallic stock is not specifically limited in shape. While the metallic stock is preferably inexpensive and especially preferably circular in section, a metallic stock being rectangular in section may be employed.

Two embodiments for obtaining a projecting portion having only a necessary amount of projection are illustrated as follows.

(i) An embodiment, in which two projecting portions, each including a surplus portion projecting excessively beyond a necessary amount of projection, are formed in the process of rough processing, and after the process of rough processing and prior to the process of formation of the side wall, a process of trimming, in which the surplus portion is cut out to make the projecting portion having only a necessary amount of projection, is performed.

(ii) An embodiment, in which a metallic stock is subjected to compression-forming in multi-stages to form two projecting portions having only a necessary amount of projection in the process of rough processing. Compression-forming described later in an embodiment 3 can be illustrated. In this embodiment, a process of trimming can be dispensed with.

While the process of formation of the side wall may be performed only by ironing processing, the following embodiment can be illustrated.

(a) An embodiment comprising bending, in which separate portions of two projecting portions are bent upright, in addition to the ironing processing of the projecting portion.

(b) An embodiment comprising pressing, in which inner surfaces of lower portions of two side walls are pressed, in addition to the ironing processing of the projecting portion.

The invention is especially suited to manufacture of a rocker arm, in which a height of side wall portions is comparatively large relative to a length of the rocker arm (specifically, 30 to 50% of the length of the rocker arm). It is possible to provide a rocker arm, in which side wall portions are made high and a roller is mounted in a high position relative to a spherical-shaped recess and a pat surface of the connecting portion.

According to the first invention, it is possible to form side wall portions without generation of defects such as crack, breakage, etc. on a metallic stock. According to the second invention, it is possible to form stem guides having a large projection height downwardly and having a high accuracy. According to the third invention, it is possible to attain these effects in combination.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE INVENTION

Figure 1A:
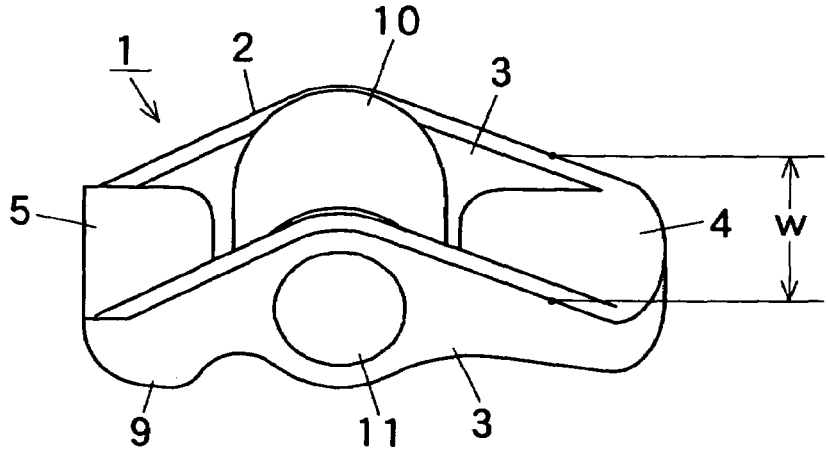
FIGS. 1A to 1C show a rocker arm manufactured by an embodiment of the invention, FIG. 1A being a perspective view as viewed from above, FIG. 1B being a perspective view as viewed from under, and FIG. 1C being a cross sectional view.

A metallic stock (32) is subjected to compression-forming by cold forging to form a connecting portion (4,5,13), side wall lower portions (3*a*) of two side wall portions (3), and two projecting portions (14) projecting beyond a rocker arm width outwardly from the side wall lower portions (3*a*), and to form, at tip ends of the side wall lower portions (3*a*), two stem guides (9) projecting downwardly lower than a pat surface (8) level of the connecting portion (5) (a process of rough processing).

Next, at least a part of the two projecting portions (14) is subjected to ironing processing to form side wall upper portions (3*b*) of the two side wall portions (3), thereby forming the two side wall portions (3) accommodated in a rocker arm width (a process of formation of a side wall).

Moreover, the two side wall portions (3) are subjected to ironing processing from outer surface sides, thereby increasing a projection height from which the stem guides (8) project downwardly (a process of working of a stem guide).

EXAMPLE 1

FIGS. 1A to 8C show an embodiment 1 of the invention. FIGS. 1A to 1C show a rocker arm 1 with a roller manufactured by a method of the present embodiment, the rocker arm 1 comprising an arm body 2 and a roller 10. The arm body 2 is formed integrally by two upright side wall portions 3 which face each other with a spacing therebetween, a base end side connecting portion 4 which connects between lower portions of both the side wall portions 3 on a base end side, and a tip end side connecting portion 5 which connects between lower portions of both the side wall portions 3 on a tip end side. According to the present embodiment, a through window 6 being rectangular in plan is defined between the base end side connecting portion 4 and the tip end side connecting portion 5.

The base end side connecting portion 4 is a pivot bearing in the form of a larger block than that of the tip end side connecting portion 5. At a lower surface of the base end side connecting portion 4, there is formed a spherical-shaped recess 7, into which a spherical-shaped head P of a pivot shaft is fitted. The tip end side connecting portion 5 is a pat in the form of a smaller block than that of the base end side connecting portion 4, and a lower surface thereof defines a convexly curved pat surface 8 to push a valve stem V.

Formed on each of tip end lower portions of the two side wall portions 3 is a stem guide 9 to project downwardly lower than the level of the pat surface 8 to interpose an end of the valve stem V. Arranged between the both sidewall portions 3 is a roller 10 that abuts against a cam C. The roller 10 is mounted rotatably on a spindle 11 which passes through the both side wall portions 3, by a bearing 12. In the present embodiment, a rocker arm width being a distance between outer surfaces of the two side wall portions 3 is a rocker arm width W being substantially constant in a major part of rocker arm except both longitudinal ends, and narrowed at both ends.

Figure 2:
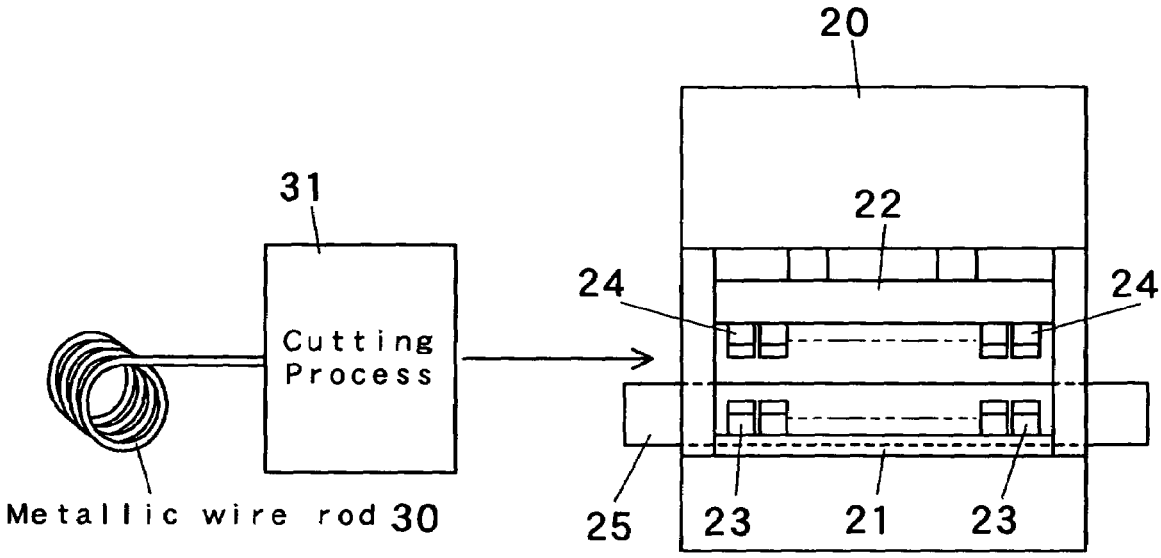
FIG. 2 is a schematic view showing an apparatus used in a manufacturing method.

In manufacture of the rocker arm 1 by cold forging, a vertical type multi-stage transfer press 20 as shown in, for example, FIG. 2 can be suitably used. The vertical type press has an advantage that it can readily include eight or more multi-stages. The transfer press 20 in the example as shown is equipped with a horizontal stationary board 21 being disposed on a lower side to be long left and right, and a horizontal movable board 22 being disposed on an upper side to be long left and right. To the stationary board 21 and the movable board 22, there are attached stationary dies 23 and movable dies 24, which face each other in a vertical direction of multi-stage sections, in successive arrangement left and right. The movable board 22 is driven by a drive device to move up and down, and all the movable dies 24 move up and down together with the movable board 22. 25 denotes a conveyance mechanism.

In a method of manufacturing the rocker arm 1 according to the present embodiment, the following processes are performed in the order as described.

(1) Cutting Process

As shown in FIG. 2, a metallic wire rod 30 having a circular-shaped section (for example, a diameter of 16 mm) is usually handled in a state of coil winding, and the metallic wire rod 30 in this state is supported on a rotary support member (not shown). The metallic wire rod 30 is unwounded starting at one end thereof to be pulled out to be fed to a homer 31. In the homer 31, the metallic wire rod 30 is cut into a predetermined length (for example, 40 mm). A columnar-shaped metallic wire rod 32 thus cut may be annealed to achieve softening, stress relieving, stabilization of structure, etc., or may not be annealed. Also, on surfaces of the metallic wire rod 32, a lubricating film may be formed to achieve an improvement in formability by, for example, phosphate processing, or the lubricating film may not be formed. In addition, the cutting process may be performed as a first process of the multi-stage press.

The above metallic wire rod 32 is fed to the multi-stage transfer press 20 and the conveyance mechanism 25 successively conveys the metallic wire rod 32 and its semi-finished product to a next stage from a stage, and the following process of rough processing, a process of trimming, and a process of formation of a side wall are consecutively performed by the multi-stage simultaneous press.

(2) Process of Rough Processing

Figure 3A:
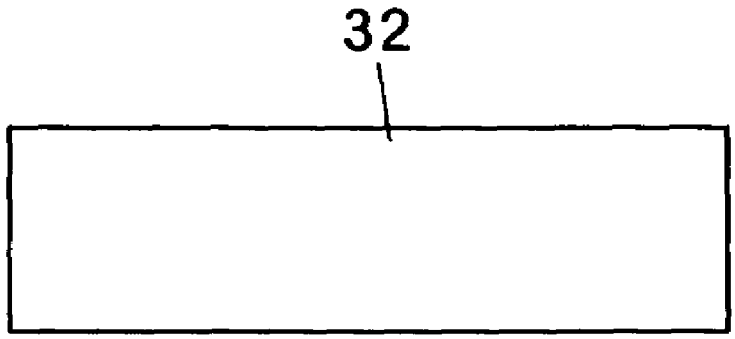
FIGS. 3A and 3B show a metallic wire rod used in an embodiment 1, FIG. 3A being a front view, and FIG. 3B being an end view.
Figure 3B:
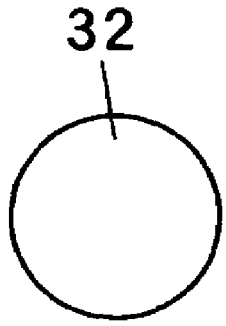
Figure 4A:
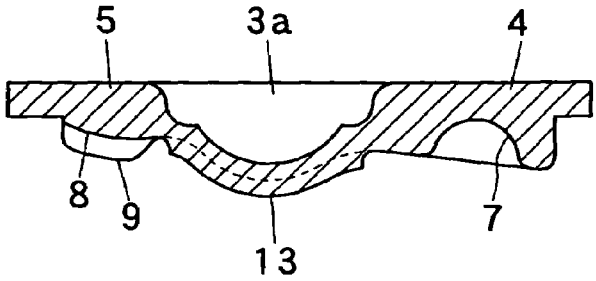
FIGS. 4A to 4C show a semi-finished product of an arm body formed by a process of rough processing of the embodiment 1, FIG. 4A being a cross sectional view, FIG. 4*b* being a bottom view, and FIG. 4*c* being a transverse, cross sectional view.
Figure 4B:
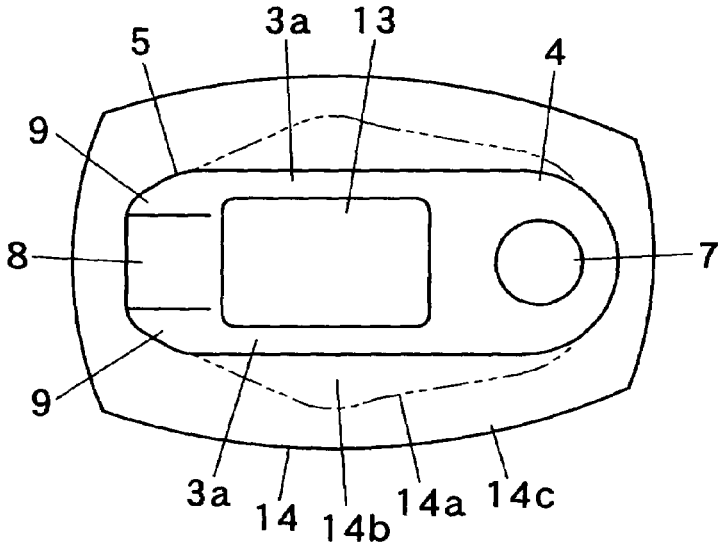
Figure 4C:
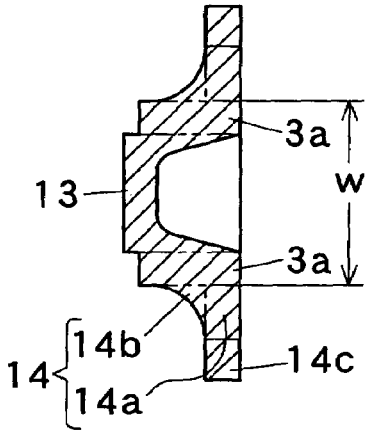

By compression-forming the metallic wire rod 32 shown in FIGS. 3A and 3B in a diametrical direction (direction perpendicular to a cross-section) by cold forging, metal flow is generated to form the base end side connecting portion 4, the tip end side connecting portion 5, an intermediate connecting portion 13, side wall lower portions 3*a* of the two side wall portions 3 which stand upright from both side ends of the connecting portions 4, 5, 13, and two projecting portions 14 curved outwardly from the upper end of the side wall lower portions 3*a* to project beyond the rocker arm width, as shown in FIGS. 4A to 4C. At the same time, by this compression-forming, at tip ends of the side wall lower portions 3*a*, two stem guides 9 which project downwardly lower than the level of the pat surface 8 are formed. The base end side connecting portion 4, the tip end side connecting portion 5, and the intermediate connecting portion 13 are continuous, and a central portion in the width direction of the intermediate connecting portion 13 projects downwardly in a stepped manner. Inner surfaces of the side wall lower portions 3*a* are inclined as being tapered downwardly, and comprise inclined portions 3*c* which exceed a thickness of the side wall portions 3.

Also, the projecting portion 14 in the present embodiment comprise a flange 14*a* bent at right angle from an outer surface of an upper end of the side wall lower portion 3*a* to project, and a curved fillet 14*b* provided between a lower surface of the flange 14*a* and the outer surface of the upper end of the side wall lower portion 3*a*. However, the both portions 14*a*, 14*b* are unitary with each other and no boundary is substantially present therebetween. Further, the flange 14*a* has a surplus portion 14*c* projecting excessively beyond a necessary amount of projection up to an extent indicated by a two-dot chain line shown in FIGS. 4A to 4C.

(3) Process of Trimming

Figure 5A:
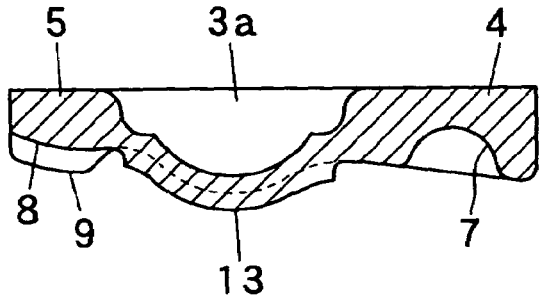
FIGS. 5A to 5C show a semi-finished product of an arm body formed by a process of trimming of the embodiment 1, FIG. 5A being a cross sectional view, FIG. 5B being a bottom view, and FIG. 5C being a transverse, cross sectional view.
Figure 5B:
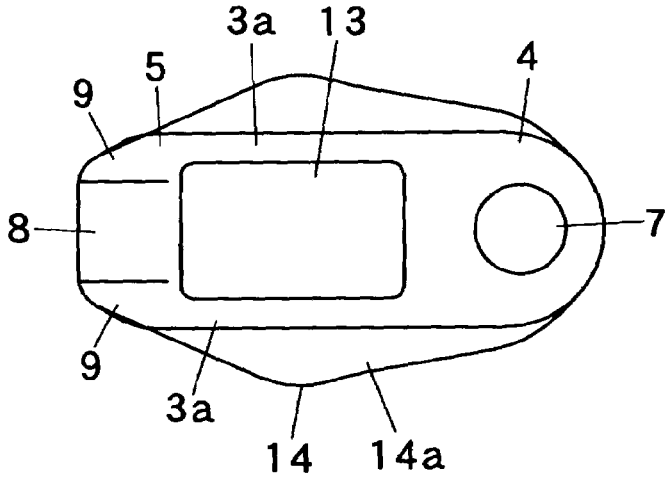
Figure 5C:
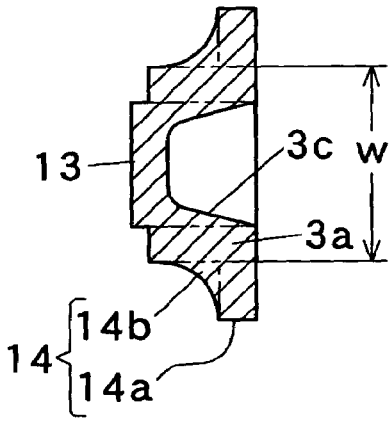
Figure 6A:
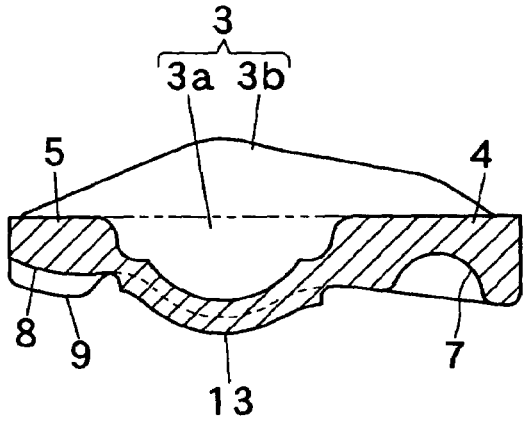
FIGS. 6A to 6D show a semi-finished arm body formed by a process of formation of the side wall of the embodiment 1, FIG. 6A being a cross sectional view, FIG. 6B being a bottom view, FIG. 6C being a transverse, cross sectional view, and FIG. 6D being an enlarged, transverse, cross sectional view showing a change from a preprocess (chain line)
Figure 6B:
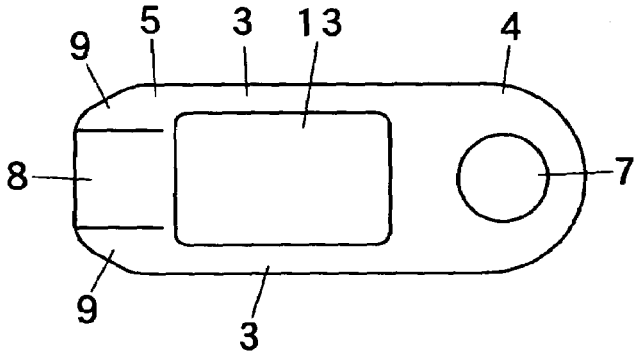
Figure 6C:
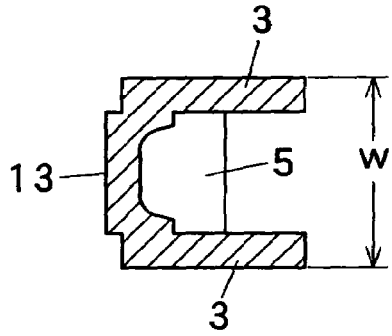
Figure 6D:
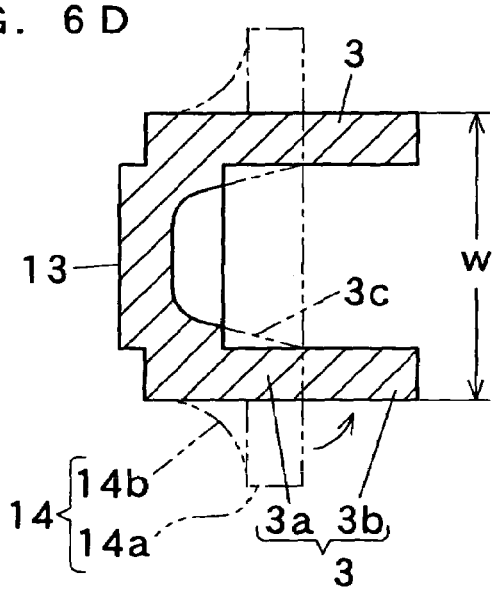

As shown in FIGS. 5A to 5C, the projecting portion 14 having a necessary amount of projection is left by cutting out the surplus portion 14C by press stamping.

(4) Process of Formation of a Side Wall

As shown in FIGS. 6A to 6D, by bending the flanges 14*a* of the projecting portions 14 upward, ironing the fillets 14*b* of the projecting portions 14 inward, and pressing the inclined portions 3*c* on the inner surfaces of the side wall lower portions 3*a*, metal flow is generated in necessary portions to form side wall upper portions 3*b* of the two side wall portions 3, thereby forming the two side wall portions 3 being accommodated in the rocker arm width. At this time, if the process is performed only by bending of the flanges 14*a*, there is a fear that defects such as crack, breakage, etc. are generated on the flanges 14*a* and hence base ends of the side wall upper portions 3*b*. According to the present embodiment, however, metal flow is generated in necessary portions by ironing the fillets 14*b* on outer surface sides and pressing the inclined portions 3*c* on the inner surface sides in addition to bending of the flanges 14*a*, there is no fear that defects such as crack, etc. are generated on the base ends of the side wall upper portions 3*b*.

(5) Process of Formation of a Window

Figure 7A:
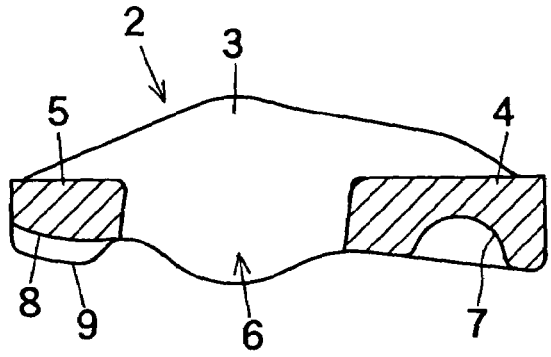
FIGS. 7A to 7C show a semi-finished arm body formed by a process of formation of a window of the embodiment 1, FIG. 7A being a cross sectional view, FIG. 7B being a bottom view, and FIG. 7C being a transverse, cross sectional view.
Figure 7B:
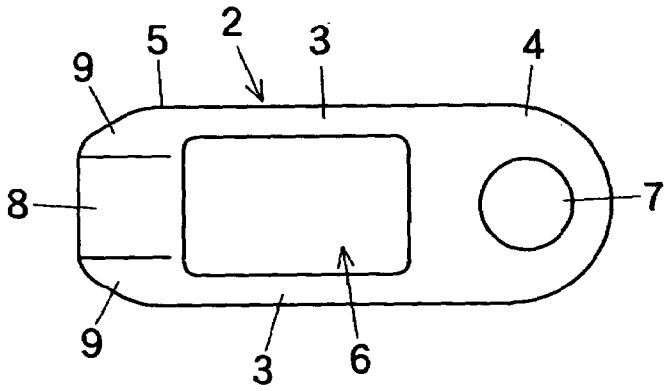
Figure 7C:
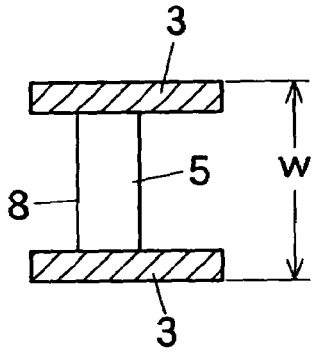

As shown in FIGS. 7A to 7C, the intermediate connecting portion 13 is stamped by press stamping to form a window 6. In addition, in the case where the roller 10 can be accommodated between the two side wall portions 3 even if no window is formed, the present process may be omitted to leave the intermediate connecting portion 13.

(6) Process of Working of a Stem Guide

Figure 8A:
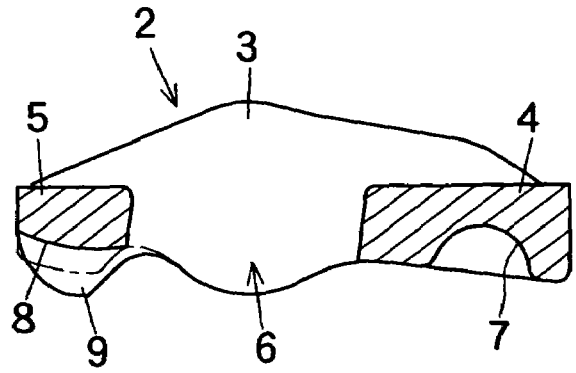
FIGS. 8A to 8C show an arm body formed by a process of working of a stem guide of the embodiment 1, FIG. 8A being a cross sectional view, FIG. 8B being a bottom view, and FIG. 8C being a transverse, cross sectional view.
Figure 8C:
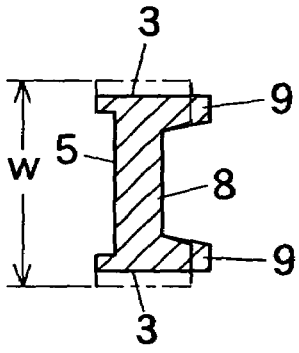
Figure 8B:
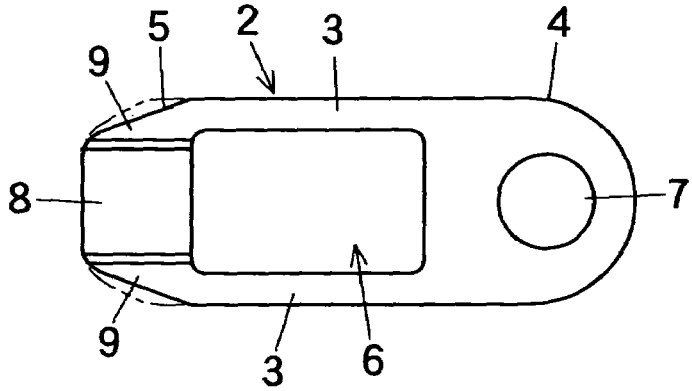
Figure 9A:
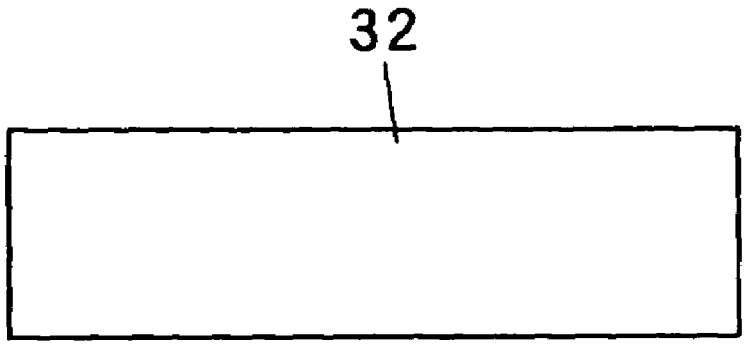
FIGS. 9A and 9B show a metallic wire rod used in an embodiment 2, FIG. 9A being a front view, and FIG. 9B being an end view.
Figure 9B:
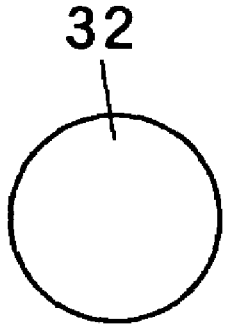

As shown in FIGS. 8A to 8C, by ironing the two stem guides 9 from outer surface sides, a projection height from which the stem guides 9 project downwardly is increased, and a spacing between the two stem guides 9 or the like is heightened in accuracy.

(7) Process of Mounting a Roller

Figure 1B:
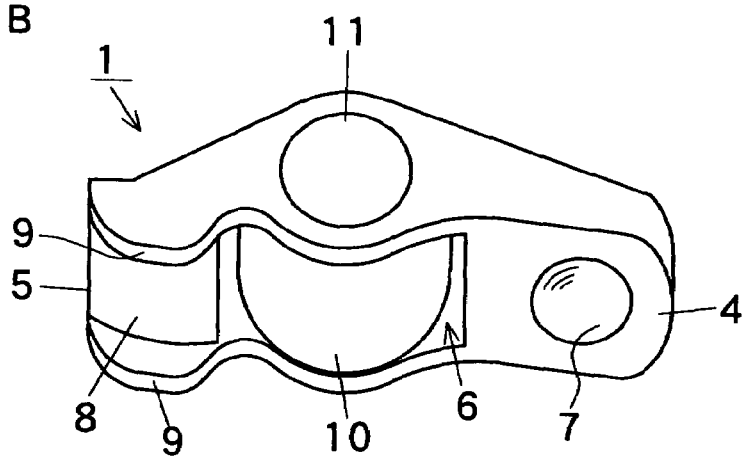
Figure 1C:
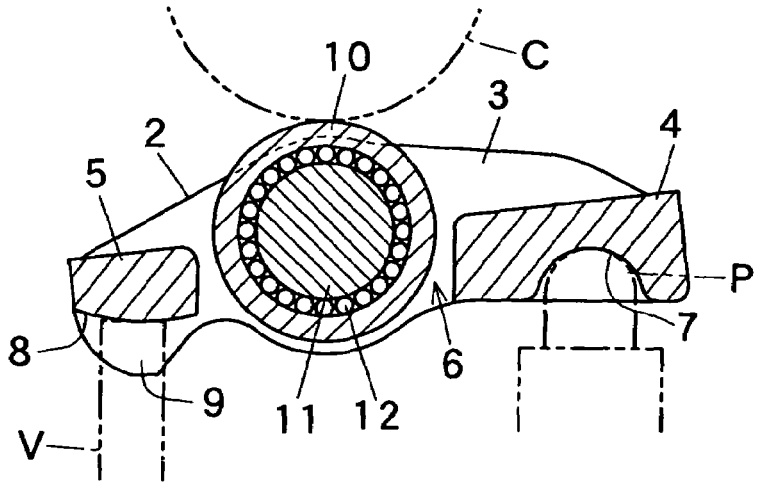

As shown in FIGS. 1A to 1C, shaft holes are formed in the two side wall portions 3, the roller 10 is arranged between the two side wall portions 3 and in the window 6, and the roller 10 is mounted rotatably on that spindle 11 which passes through the shaft holes, by the bearing 12.

EXAMPLE 2

FIGS. 9A to 12D show an embodiment 2 of the invention. The present embodiment is different from the embodiment 1 only in that projecting portions 14 being worked by rough processing are changed in shape to decrease surplus portions 14*c* cut out by trim processing, and a process of formation of a side wall is performed with ironing processing and pressing processing (bending process is not performed), and common to the embodiment 1 in other processes and the structure of a rocker arm 1 being manufactured.

Figure 10A:
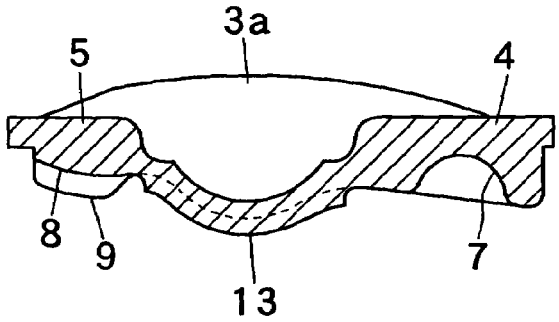
FIGS. 10A to 10C show a semi-finished product of an arm body formed by a process of rough processing of the embodiment 2, FIG. 10A being a cross sectional view, FIG. 10B being a bottom view, and FIG. 10C being a transverse, cross sectional view.
Figure 10B:
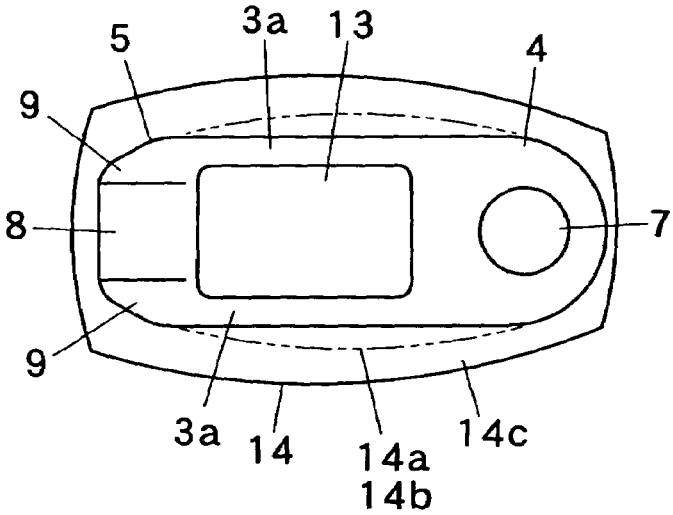
Figure 10C:
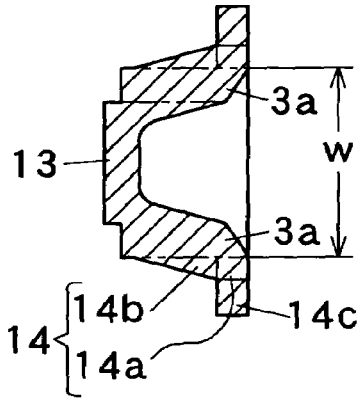

Hereupon, such difference is mainly described. In the rough processing, the present embodiment is common to the embodiment 1 in that a base end side connecting portion 4, a tip end side connecting portion 5, an intermediate connecting portion 13, side wall lower portions 3*a*, projecting portions 14, and stem guides 9 are formed by compression-forming a metallic wire rod 32 shown in FIGS. 9A and 9B in a diametrical direction by cold forging as shown in FIGS. 10A to 10C. In the present embodiment, however, the side wall lower portions 3*a* are formed to be higher than those in the embodiment 1, while an amount of projection of flanges 14*a* is made smaller than that in the embodiment 1 and surplus portions 14*c* are decreased compared with that in the embodiment 1.

Figure 11A:
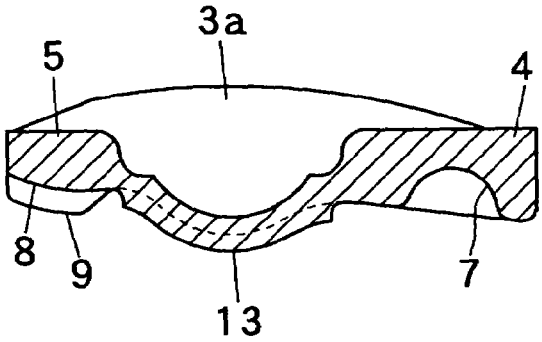
FIGS. 11A to 11C show a semi-finished product of an arm body formed by a process of trimming of the embodiment 2, FIG. 11A being a cross sectional view, FIG. 11B being a bottom view, and FIG. 11C being a transverse, cross sectional view.
Figure 11B:
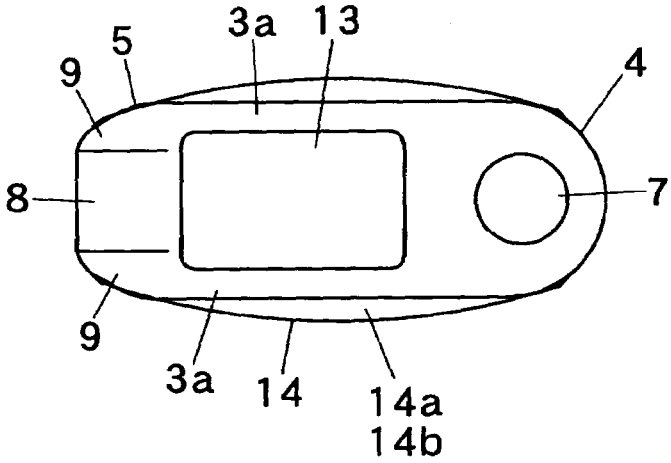
Figure 11C:
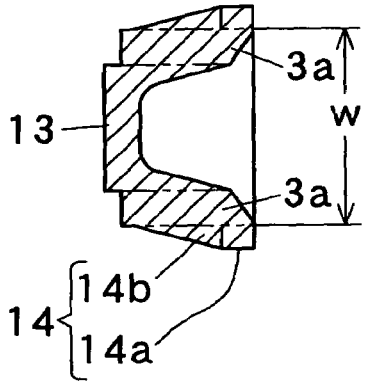
Figure 12A:
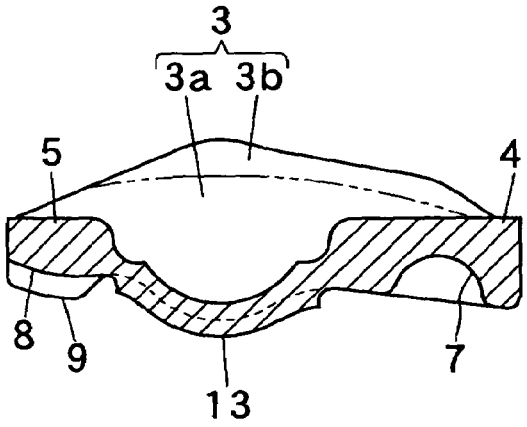
FIGS. 12A to 12D show an arm body formed by a process of formation of the side wall of the embodiment 2, FIG. 12A being a cross sectional view, FIG. 12B being a bottom view, FIG. 12C being a transverse, cross sectional view, and FIG. 12D being an enlarged, transverse, cross sectional view showing a change from a preprocess (chain line)
Figure 12B:
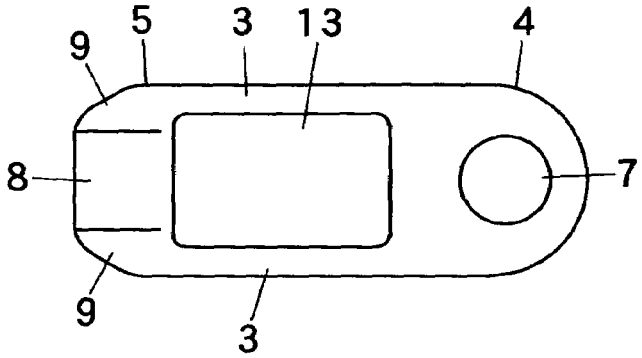
Figure 12C:
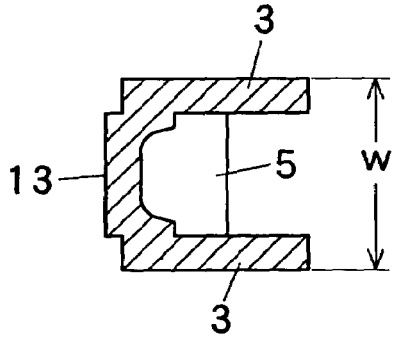
Figure 12D:
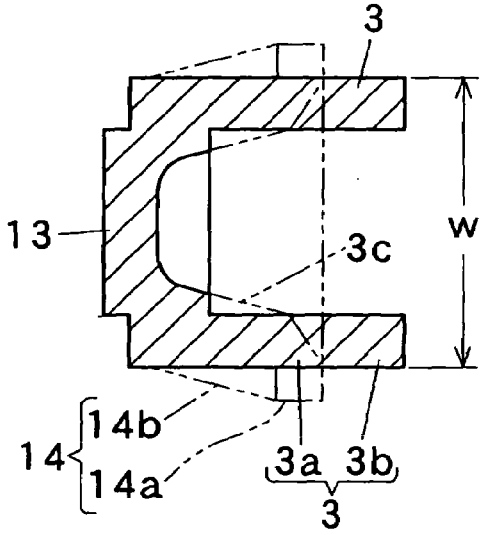

In the trim processing, as shown in FIG. 11A to 11C, the surplus portions 14*c* are cut out to trim the flanges 14*a* of the projecting portions 14 to the same extent as the amount of projection of fillets 14*b*, thereby making the projecting portions 14 having a necessary amount of projection.

Also, as shown in FIGS. 12A to 12D, in the process of formation of the side wall, the trimmed flanges 14*a* and the fillets 14*b* of the projecting portions 14 are subjected to ironing inwardly, and inclined portions 3*c* on inner surfaces of the side wall lower portions 3*a* are subjected to pressing processing, so that metal flow is generated to form side wall upper portions 3*b* of two side wall portions 3 and hence the two side wall portions 3 accommodated in a rocker arm width are formed. Also, in the present embodiment, there is no fear that defects such as crack, etc. are generated on base ends of the side wall upper portions 3*b*.

The rocker arm 1 having the same structure as that of the embodiment 1 can be obtained by performing the subsequent processes in the same manner as in the embodiment 1.

EXAMPLE 3

FIGS. 13A to 17C show an embodiment 3 of the invention. The present embodiment is different from the embodiment 2 only in that projecting portions 14 obtained in the trim processing of the embodiment 2 are formed in rough processing to dispense with the process of trimming, and common to the embodiment 1 in other processes and the structure of a rocker arm 1 being manufactured.

Figure 13A:
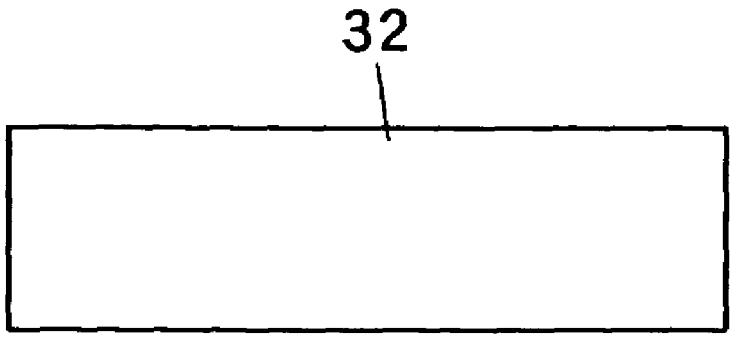
FIGS. 13A and 13B show a metallic wire rod used in an embodiment 3, FIG. 13A being a front view, and FIG. 13B being an end view.
Figure 13B:
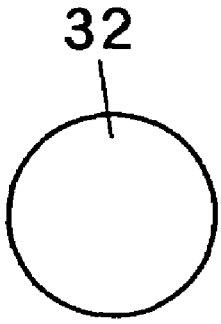
Figure 14:
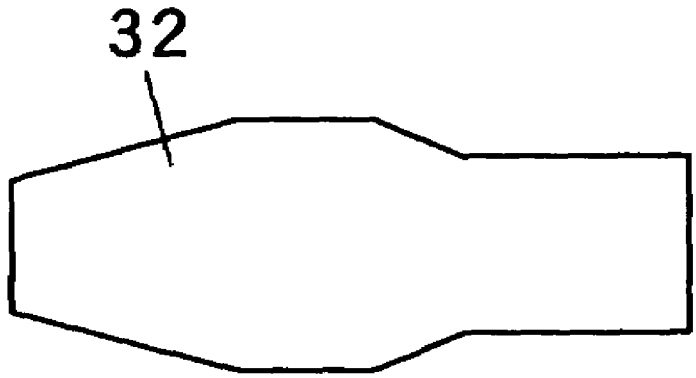
FIG. 14 is a front view showing a metallic wire rod subjected to compression-forming in an axial direction in a process of rough processing.
Figure 15A:
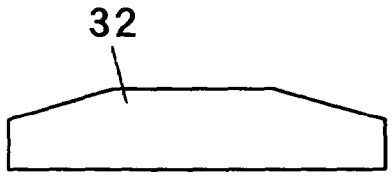
FIGS. 15A to 15C show a metallic wire rod further subjected to compression-forming in a diametrical direction, FIG. 15A being a front view, FIG. 15B being a bottom view, and FIG. 15C being a side view.
Figure 15B:
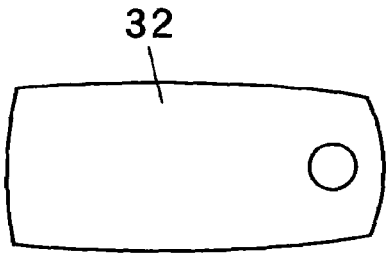
Figure 15C:
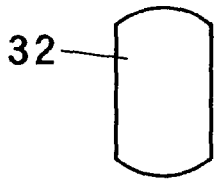
Figure 16A:
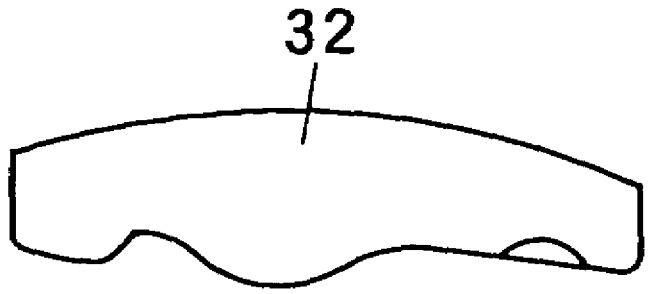
FIGS. 16A and 16B show a metallic wire rod further subjected to compression-forming, FIG. 16A being a front view, and FIG. 16B being a bottom view.
Figure 16B:
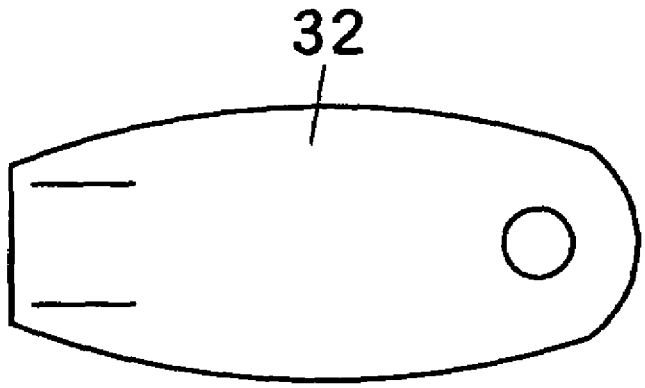
Figure 17A:
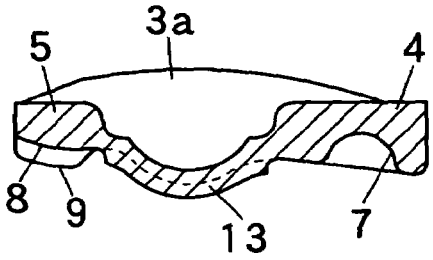
FIGS. 17A to 17C show a semi-finished product of an arm body further subjected to compression-forming, FIG. 17A being a cross sectional view, FIG. 17B being a bottom view, and FIG. 17C being a transverse, cross sectional view.
Figure 17B:
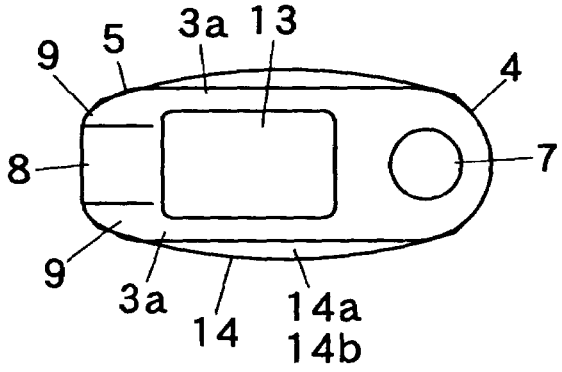
Figure 17C:
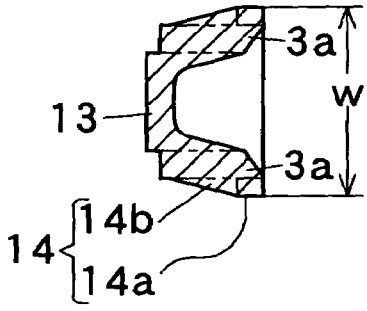

Hereupon, such difference is mainly described. In the rough processing, a metallic wire rod 32 shown in FIGS. 13A and 13B is first subjected to compression-forming in a longitudinal direction (axial direction) by cold forging, whereby a central portion in the longitudinal direction is bulged as shown in FIG. 14. Subsequently, the metallic wire rod 32 thus bulged is subjected to compression-forming in a diametrical direction by cold forging to be made a flat block, of which the central portion in the longitudinal direction is also bulged in a widthwise direction and in a thickness direction as shown in FIGS. 15A to 15C. Subsequently, the flat block is subjected to compression-forming to be made similar in shape to an arm body 2 as shown in FIGS. 16A and 16B, and further subjected to compression-forming to form projecting portions 14 having only a necessary amount of projection as shown in FIGS. 17A to 17C.

In this manner, according to the present embodiment, projecting portions 14 having a necessary amount of projection are formed while volume adjustment of a metallic stock is achieved in rough processing by plural stages of compression-forming, so that there is an advantage that the process of trimming is dispensed with. The rocker arm having the same structure as that of the embodiment 1 can be obtained by performing the subsequent processes in the same manner as in the embodiment 2.

The present invention is not limited to the above embodiment, and various modifications may be properly made without departing from the subject matter of the present invention.

What is claimed is:

1. A method of manufacturing a rocker arm including two upright side wall portions and a connecting portion connecting between the side wall portions, the method comprising:

a process of rough processing, in which a metallic stock is subjected to compression-forming by cold forging to form a connecting portion, side wall lower portions of two side wall portions, and two projecting portions projecting beyond a rocker arm width outwardly from the side wall lower portions; and a process of formation of a side wall, in which at least a part of the two projecting portions is subjected to ironing processing to form side wall upper portions of the two side wall portions, thereby forming the two side wall portions accommodated in the rocker arm width.

2. The method of manufacturing a rocker arm according to claim 1, wherein the two projecting portions, each including a surplus portion projecting excessively beyond a necessary amount of projection, are formed in the process of rough processing, and after the process of rough processing and prior to the process of formation of the side wall, a process of trimming, in which the surplus portion is cut out to make the projecting portion having only a necessary amount of projection, is performed.

3. The method of manufacturing a rocker arm according to claim 1, wherein the metallic stock is subjected to compression-forming in multi-stages to form the two projecting portions having only a necessary amount of projection in the process of rough processing.

4. The method of manufacturing a rocker arm according to claim 1, wherein the process of formation of the side wall comprises bending, in which separate portions of the two projecting portions are bent upright, in addition to the ironing processing of the projecting portion.

5. The method of manufacturing a rocker arm according to claim 1, wherein the process of formation of the side wall comprises pressing, in which inner surfaces of the two side wall lower portions are pressed, in addition to the ironing processing of the projecting portion.

6. A method of manufacturing a rocker arm including two upright side wall portions and a connecting portion connecting between the side wall portions, the method comprising:

a process of rough processing, in which a metallic stock is subjected to compression-forming by cold forging to form a connecting portion, and side wall lower portions of two side wall portions, and to form, at tip ends of the side wall lower portions, two stem guides projecting downwardly lower than a level of a pat surface of the connecting portion; and a process of working of a stem guide, in which the two side wall portions are subjected to ironing processing from outer surface sides, thereby increasing a projection height from which the stem guide projects downwardly.

7. A method of manufacturing a rocker arm including two upright side wall portions and a connecting portion connecting between the side wall portions, the method comprising:

a process of rough processing, in which a metallic stock is subjected to compression-forming by cold forging to form a connecting portion, side wall lower portions of two side wall portions, and two projecting portions projecting beyond a rocker arm width outwardly from the side wall lower portions and to form, at tip ends of the side wall lower portions, two stem guides projecting downwardly lower than a level of a pat surface of the connecting portion;

a process of formation of a side wall, in which at least a part of the two projecting portions is subjected to ironing processing to form side wall upper portions of the two side wall portions, thereby forming the two side wall portions accommodated in the rocker arm width; and a process of working of a stem guide, in which the two side wall portions are subjected to ironing processing from outer surface sides, thereby increasing a projection height from which the stem guide projects downwardly.

8. The method of manufacturing a rocker arm according to claim 7, wherein the two projecting portions, each including a surplus portion projecting excessively beyond a necessary amount of projection, are formed in the process of rough processing, and after the process of rough processing and prior to the process of formation of the side wall, a process of trimming, in which the surplus portion is cut out to make the projecting portion having only a necessary amount of projection, is performed.

9. The method of manufacturing a rocker arm according to claim 7, wherein the metallic stock is subjected to compression-forming in multi-stages to form the two projecting portions having only a necessary amount of projection in the process of rough processing.

10. The method of manufacturing a rocker arm, according to claim 7, wherein the process of formation of the side wall comprises bending, in which separate portions of the two projecting portions are bent upright, in addition to the ironing processing of the projecting portion.

11. The method of manufacturing a rocker arm according to claim 7, wherein the process of formation of the side wall comprises pressing, in which inner surfaces of the two side wall lower portions are pressed, in addition to the ironing processing of the projecting portion.

* * * * *